US005528773A

United States Patent [19]

Lowinger

[11] Patent Number: 5,528,773

[45] Date of Patent: Jun. 25, 1996

[54] GLOVE WITH WRITING ON HOOK AND LOOP

[75] Inventor: Daniel J. Lowinger, Cranston, R.I.

[73] Assignee: Acushnet Company, Fairhaven, Mass.

[21] Appl. No.: 342,286

[22] Filed: Nov. 18, 1994

[51] Int. Cl.[6] ..... A41D 19/00

[52] U.S. Cl. ..... 2/161.4; 24/442; 2/917

[58] Field of Search ..... 24/306, 442; 101/35; 2/161.4

[56] References Cited

U.S. PATENT DOCUMENTS 4,734,298 3/1988 Kikukawa ..... 101/35 X 4,766,611 8/1988 Kim ..... 2/161.4 X 4,962,547 10/1990 Minnick ..... 2/161.4

5,188,469 2/1993 Nagao et al. ..... 400/615.2

5,365,609 11/1994 Herzog ..... 2/161.4

*Primary Examiner*—C. D. Crowder

*Assistant Examiner*—Shirra L. Jenkins

*Attorney, Agent, or Firm*—Pennie & Edmonds

[57] ABSTRACT

A glove having a flap closure attachable to the glove body using hook and loop fastener material both on the flap and the glove body. A writing appears on the outside of the flap closure and a writing appears on or within the fastener material attached to the glove body and obscured when the flap is closed.

2 Claims, 2 Drawing Sheets

GLOVE WITH WRITING ON HOOK AND LOOP

BACKGROUND OF THE INVENTION

It has been proposed to imprint with paste hook and loop materials (U.S. Pat. No. 4,734,298) and it has been the practice to imprint the outer surface of a golf closure strap; however, imprinting of glove closures as herein described has not heretofore been proposed.

SUMMARY OF THE INVENTION

Broadly, the present invention comprises a glove having a body section divided in the back into portions for ready insertion of the hand in which the hook and loop flap carries a writing on the outside of the flap and a writing on the hook and loop material hidden when the flap is in the closed position.

It is a feature that the hook and loop material positioned below the flap, when closed, may be transparent to make the writing more visible.

DESCRIPTION OF THE PREFERRED EMBODIMENT

Figure 1:
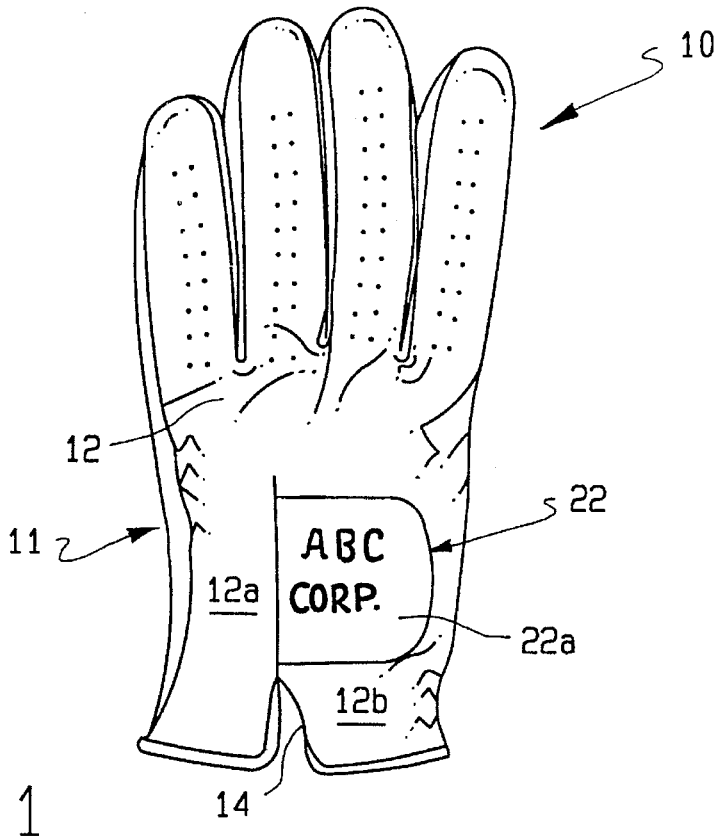
FIG. 1 is a back view of a glove showing the closure flap in closed position.
Figure 2:
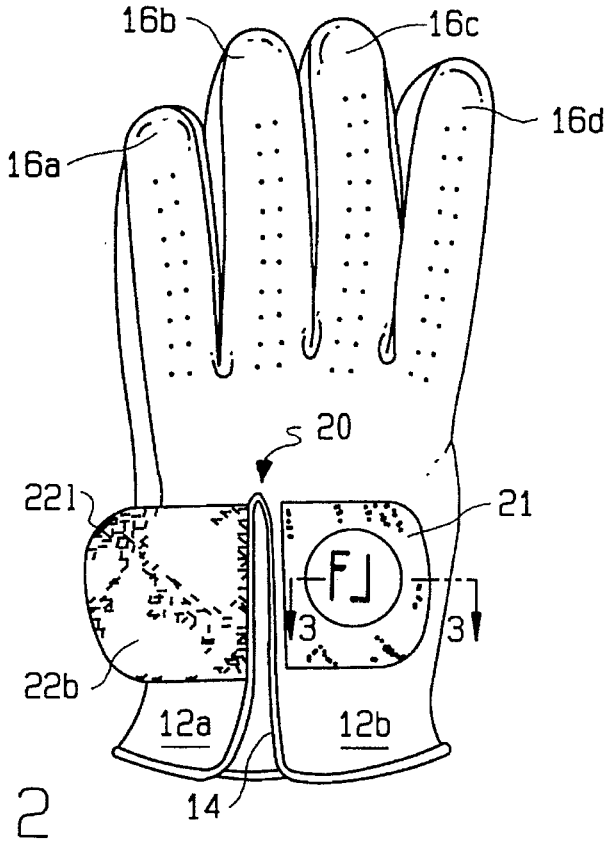
FIG. 2 is a view similar to FIG. 1 with the flap in its full open position.
Figure 3:
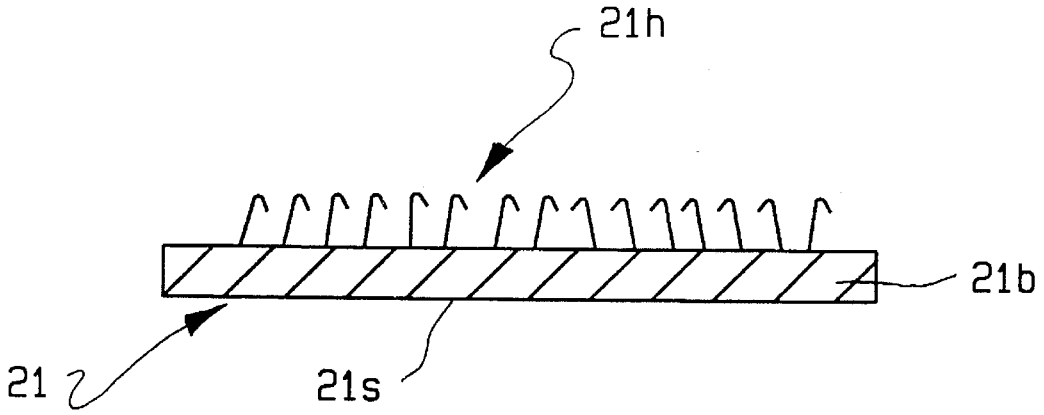
FIG. 3 is a sectional view taken along line 3—3 of FIG. 2.
Figure 4:
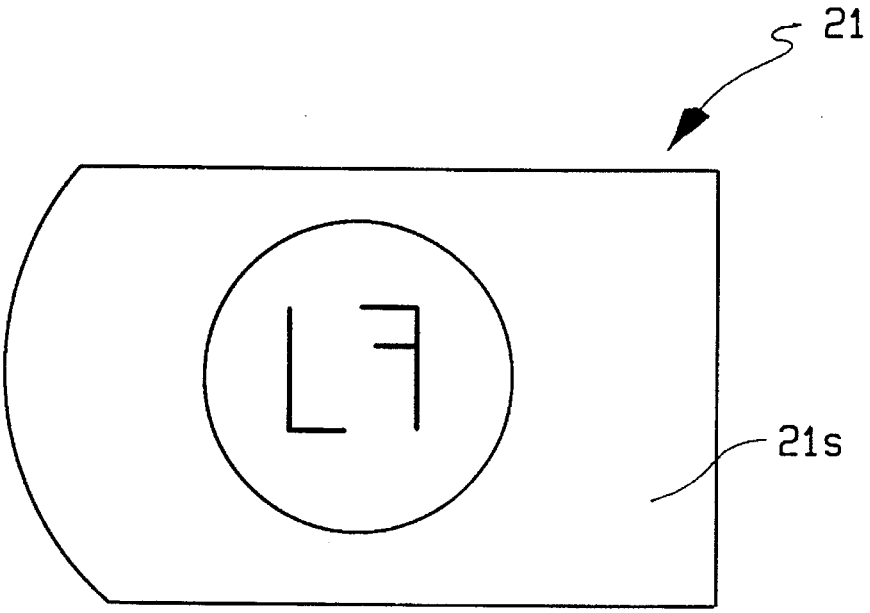
FIG. 4 is a bottom view of the hook pad.

Referring to FIGS. 1–4, leather glove 10, i.e. a golf glove, has glove body 11, back body portion 12 which comprises two sections 12*a*, 12*b* separated by back opening 14 and finger casings 16*a*–*d*. Gloves may also be made of synthetic materials or a combination of leather and synthetic material.

Back opening 14 eases pulling glove 10 on the wearer's hand. Once the hand is inside glove 10, adjustable closure 20 is closed. Closure 20 includes hook or loop pad 21 made of a transparent hook or loop material so that writing on the back of pad 21, such as logo FJ in a circle, is visible. In the present embodiment, transparent pad 21 consists of pad base 21*b* comprised of transparent material such as vinyl or nylon and hooks 21*h*. The side opposite hooks 21*h*, side 21*s* on FIGS. 3 and 4, of pad base 21*b* is printed with FJ and a circle with the F and J being backward so that when pad base 21*b* is attached to glove body 11, the backward F and J appear forward and correct in FIG. 2. Closure 20 also includes swingable hook or loop closure flap 22 having outside leather surface 22*a* with another writing such as ABC Corp. on it. The inside surface 22*b* with no writing on it carries in this embodiment loops 22*l*. Closure 20 may have hook material on inside surface 22*b* and loop material on pad 21.

I claim:

1. A glove having a body, a back body portion divided into two back body sections separated by an opening and a hook and loop closure for closing the back sections, the hook and loop closure comprising a) a flap swingably connected to one of such back body sections, such flap having an outside surface and an inside surface with hooks or loops thereon; and b) a complementary hook or loop pad attached to the other back section, the pad having hooks or loops on one side facing the flap and indicia on the opposite side, said pad being comprised of a transparent material on which the indicia is positioned, whereby said indicia is visible on the one side.

2. The glove of claim 1, wherein the entire pad including the hooks or loops is comprised of a transparent material.

* * * * *